US006964292B2

(12) United States Patent
Meyer et al.

(10) Patent No.: US 6,964,292 B2
(45) Date of Patent: Nov. 15, 2005

(54) PROCESS OF FABRICATING CASTINGS PROVIDED WITH INSERTS, WITH IMPROVED COMPONENT/INSET MECHANICAL COHESION, AND AN INSERT USABLE IN THE PROCESS

(75) Inventors: Philippe Meyer, Ronquerolles (FR); Dominique Bardinet, Paris (FR); Franck Plumail, Osny (FR); Gérard Lesueur, Cires-Les-Mello (FR)

(73) Assignee: Montupet S.A., Clichy (FR)

( * ) Notice: Subject to any disclaimer, the term of this patent is extended or adjusted under 35 U.S.C. 154(b) by 0 days.

(21) Appl. No.: 09/953,750

(22) Filed: Sep. 14, 2001

(65) Prior Publication Data

US 2002/0046822 A1 Apr. 25, 2002

(30) Foreign Application Priority Data

Sep. 15, 2000 (FR) ..... 00 11784

(51) Int. Cl.[7] ..... B22D 19/08; B22C 3/00
(52) U.S. Cl. ..... 164/101; 164/72; 164/74
(58) Field of Search ..... 164/100, 101, 164/72, 74

(56) References Cited

U.S. PATENT DOCUMENTS

| | | | | |
|---|---|---|---|---|
| 2,411,998 A | * | 12/1946 | Kelly et al. | 76/107.1 |
| 3,963,502 A | * | 6/1976 | Borbely et al. | 106/38.28 |
| 5,179,994 A | | 1/1993 | Kuhn | |
| 6,615,901 B2 | * | 9/2003 | Kaminski et al. | 164/137 |

FOREIGN PATENT DOCUMENTS

| | | |
|---|---|---|
| EP | 0363844 | 4/1990 |
| FR | 2633944 | 1/1990 |
| FR | 2775917 | 9/1999 |

* cited by examiner

*Primary Examiner*—Kuang Y. Lin
(74) *Attorney, Agent, or Firm*—Blakely Sokoloff Taylor & Zafman

(57) ABSTRACT

A process of fabricating a light alloy casting, such as an aluminum alloy casting, including at least one metal insert includes applying a coating of lampblack to a face of the insert intended to be in contact with the alloy of the component and casting the component with the molten alloy in a mold cavity in which the insert is positioned. Applications include fabricating engine blocks with integrally cast liners made of cast iron.

16 Claims, 1 Drawing Sheet

PROCESS OF FABRICATING CASTINGS PROVIDED WITH INSERTS, WITH IMPROVED COMPONENT/INSET MECHANICAL COHESION, AND AN INSERT USABLE IN THE PROCESS

BACKGROUND OF THE INVENTION

1. Field of the Invention

The present invention relates generally to casting light alloy components, for example aluminum alloy components, and more particularly to casting components incorporating metal inserts.

One non-limiting example of such components is internal combustion engine cylinder blocks incorporating inserts consisting of cylinder liners.

2. Description of the Prior Art

To make some cast aluminum components, for example engine cylinder blocks, it is currently necessary to use at some locations inserts made from a material other than that from which the component is cast. In the case of light alloy engine blocks, the most widely used technology consists in integrally casting cast iron liners which, in the assembled engine, come into contact with the piston rings. The insert is given a satisfactory mechanical attachment surface, for example by machining helicoidal grooves into the external surface of the liners. If the liquid aluminum penetrates properly into them, the mechanical strength of the combination is satisfactory.

It appears that if the liners are placed in the mold cold, whether this is a metal mold (low-pressure or shell gravity type processes) or a green sand mold, for example as described in the document FR 2 775 917 A in the name of the applicant, it is not possible to guarantee correct coating of the cast iron liners by the liquid aluminum, whatever the conditions for preparing the surface of the machined insert (shot-blasting, degreasing, etc), and whatever the casting conditions (provided that they lie within a range of parameter values enabling an engine block free of functional defects to be obtained). This results in voids in the aluminum, caused by misruns and blowholes, at places on the outside surface of the liners, and in particular in the areas between the liners, which are functionally unacceptable because they seriously compromise the mechanical cohesion between the engine block and the liners.

One prior art method of overcoming this problem consists of heating the liners, either in a separate furnace, before they are inserted into the mold, in the case of processes using metal molds, or by boring orifices in the sand, in the case of processes using sand molds, through which electrical inductors are passed as far as the interior space of the liners, to heat the liners inductively in the mold before casting the metal.

However, in this type of application these heating techniques represent a penalty from the points of view of investment, complexity of use and control. Failing better solutions, these techniques are nevertheless used at present to make internal combustion engine blocks with integrally cast liners made of cast iron.

An object of the present invention is to alleviate these limitations of the prior art and to obtain good coating of the insert by the liquid aluminum alloy, combined with intimate contact between the insert and the aluminum alloy after solidification, without preheating the insert prior to casting the aluminum alloy.

SUMMARY OF THE INVENTION

Accordingly, in a first aspect, the present invention proposes a process of fabricating a light alloy casting, such as an aluminum alloy casting, including at least one metal insert, which process includes the following steps:

applying a coating of lampblack to a face of the insert intended to be in contact with the alloy of the component, and casting the component with the molten alloy in a mold cavity in which the insert is positioned.

Preferred but non-limiting aspects of the method according to the invention are as follows:

The application step is carried out before introducing the insert into a mold cavity.

The process further includes the step of fixing the insert to a sand core and placing the core in the mold cavity.

The step of fixing the insert to a core includes positioning the insert in a core box and then firing the core.

The step of applying a coating of lampblack to the insert is carried out before fixing the insert to the core.

The step of applying a coating of lampblack is carried out by exposing the face of the insert to a flame.

There is relative movement between the insert and the flame during the exposure of the insert to the flame.

The step of applying a coating of lampblack is carried out by spraying onto the face of the insert a solution containing lampblack in suspension.

The solution is based on an alcohol such as methanol.

The solution contains a dispersive agent such as gum arabic.

The component is an internal combustion engine block and the insert is a cylinder liner for the engine block.

The liner is made of cast iron.

The outside face of the liner has a surface with hollows and reliefs.

The step of applying a coating of lampblack to the liner applies the coating to the whole of the outside face of the liner.

The engine block has a plurality of inserts each constituting a cylinder liner.

In a second aspect, the present invention proposes a metal insert adapted to be fastened to a light alloy casting, such as an aluminum alloy casting, during casting of the component in a mold cavity, which insert has a coating of lampblack on a face adapted to be in contact with the alloy of the component.

In a preferred application, in which the casting is an internal combustion engine block, the insert constitutes a cylinder liner, made of cast iron, for example.

The whole of the external surface of the insert is advantageously coated with lampblack.

Other aspects, objects and advantages of the present invention will become more apparent on reading the following detailed description of preferred embodiments of the invention, which description is given by way of non-limiting example and with reference to the accompany drawing.

DETAILED DESCRIPTION OF THE PREFERRED EMBODIMENT

Figure 1:
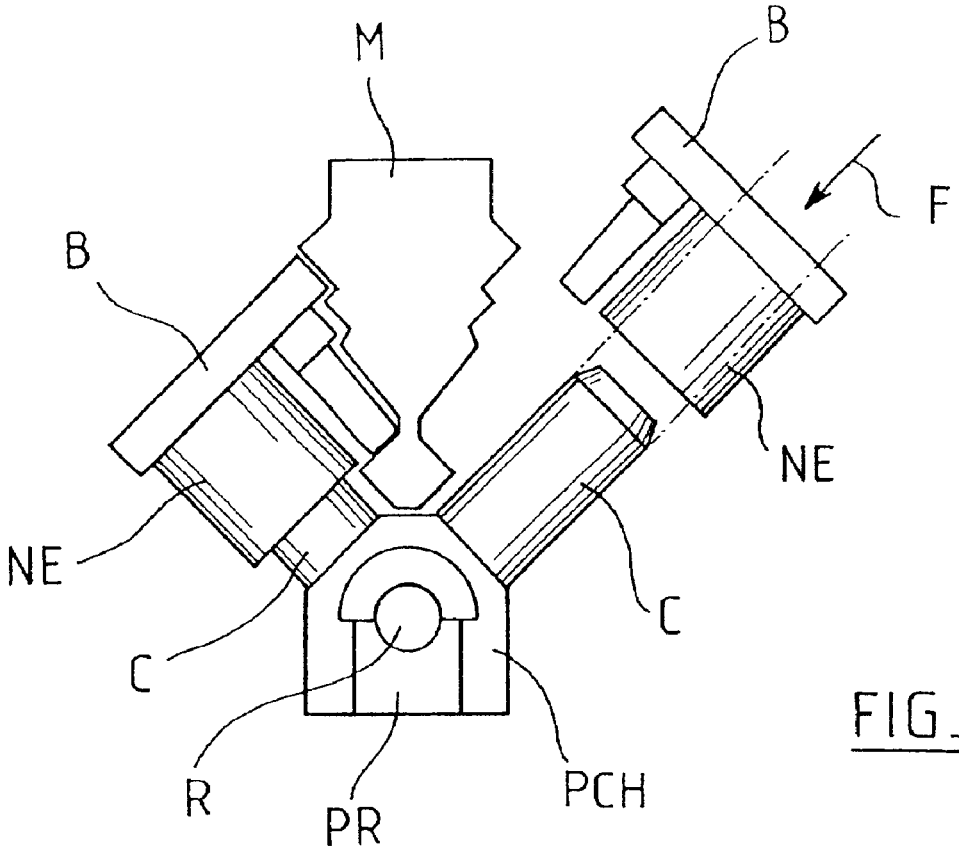
FIG. 1 is a diagrammatic view in cross section of a set of cores and inserts used to make an engine block by a process in accordance with the invention.
Figure 2:
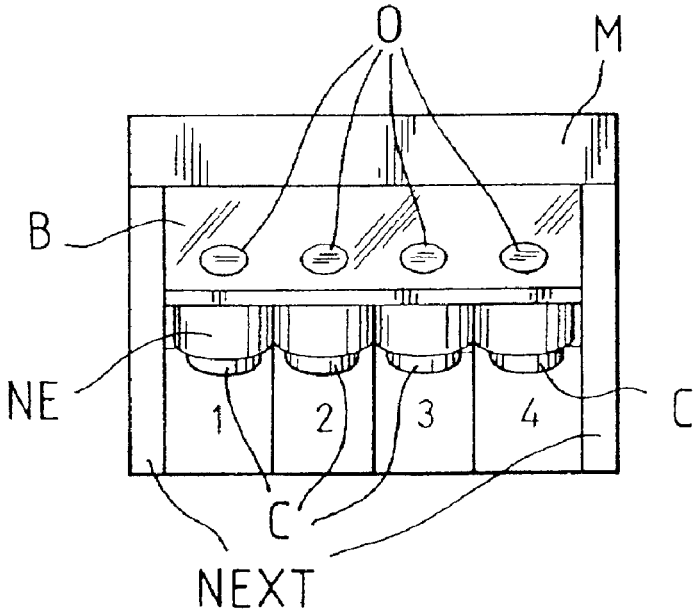
FIG. 2 is a side view in elevation of the set of cores and inserts from FIG. 1 to a slightly smaller scale.

FIGS. 1 and 2 show a set of cores and inserts for making an engine block equipped with liners by a process in accordance with the invention.

As in the prior art, the set of cores and inserts includes:

water cores NE for forming cooling liquid passages in the block, seat cores B, liner support cores PCH, of which there are four in this example (which applies to a V8 engine), each supporting two cast iron liners C, a bearing core PR with a chill R, and a riser core M.

The seat cores B are assembled to the remainder of the set of cores in the direction of the arrow F, each water core NE covering a respective liner C over a particular distance so that, when the engine block is cast, molten metal penetrates into the gap between the external face of each liner and the internal face of the respective water core, the objective being to provide a satisfactory mechanical bond between the solidified alloy and each liner.

FIG. 2 shows in particular the four liner support cores PCH assembled side by side, the liners C fixed to the cores, and end cores NEXT. This figure also shows openings 0 provided, as in the prior art method discussed above, for inserting induction heating members for heating the liners C from the inside.

In accordance with the invention, and to ensure excellent adhesion to the liners C of the molten alloy used to cast the engine block, the outside surface of the liners is coated with lampblack.

This coating can be effected by either of the following two methods, described here by way of non-limiting example:

Method 1: the liners are coated by exposing them to the lampblack resulting directly from the combustion of a flame adjusted for this purpose. A homogeneous coating is obtained over the whole of the outside surface of the liners by turning and moving the liners over the flame using suitable manual or automatic handling means.

The typical treatment time for each liner is of the order of 20 to 60 seconds for cast iron liners with the following approximate dimensions:

outside diameter: 70 to 110 mm, height: 90 to 140 mm.

The liners prepared in the above manner are ready to be placed in the metal or sand mold prior to casting.

Method 2: the lampblack can instead be sprayed onto the liners, which can have advantages for automating the method in the context of mass production. One option is to dilute the lampblack in methanol, typically at the rate of 5 to 15 wt %, keeping the lampblack in suspension by means of an appropriate agitator. The suspension is then sprayed using a conventional release agent gun at a compressed air pressure of the order of $2.10^5$ Pa, the pressure being adjusted according to the type of gun to obtain as regular as possible a layer of lampblack on the liner.

An agent for stabilizing the dispersion of lampblack, for example gum arabic, can be added to the suspension if necessary.

Whichever method is used, the coating is preferably applied after assembling the set of cores, and in particular the liner support cores described above, and before placing the set of cores in the mold cavity.

With both of the methods described above, microscopic examination and testing of the mechanical strength of the liners prepared in this way and maintained at room temperature in the mold after depositing the lampblack showed that they were perfectly "wetted" by the liquid aluminum alloy during filling of the mold. In this way, the external relief (not shown in detail in the figures, and formed of striations, grooves, etc, for example, as described above) is in intimate contact with the aluminum alloy after the component has solidified. This results in excellent mechanical retention of the liners in the engine block.

The advantages of the present invention will become more apparent in the light of the following examples:

EXAMPLE A (PRIOR ART)

A 5.7 liter V8/90° engine block was produced using an overturning casting process with a green sand mold, such as described in the document FR 2 775 917 A cited above, and cast iron liners with the following dimensions:

inside diameter: 96 mm, outside diameter: 103.5 mm, height: 135 mm.

The eight liners were positioned in the core boxes for forming the interior parts of the block before firing the cores, so that there was an intimate bond between the liners and the parts of the liner support cores PCH that penetrate to the interior of the liners after firing in the coremaking machine. This technique for fastening the liners to the cores is known in the art and is not described further.

The total weight of the cores was 90 kg. As described above, the set of cores consisted of four liner support cores PCH each carrying two liners C, two end cores NEXT, two water cores NE supported by two seat cores B, a riser core M and a crankshaft bearing core PR with a cast iron chill R on the crankshaft axis, arranged as shown in FIGS. 1 and 2. This set of cores was produced in a cold box in the conventional way. One critical feature of the block is the liner environment, consisting of the alternation of a liner, 3 mm of aluminum alloy, 2 to 3 mm of water passage (defined by the water core), 3 mm of aluminum alloy, then the next liner, etc. The block was cast with risers to feed the faces of the block on the cylinder head gasket side, with a yield of the order of 1.6 (86 kg of poured alloy for a 46 kg component, after eliminating the risers).

The block was cast in a green sand mold contained in two metal frames each having dimensions of 800×650×300 mm.

All of the sand used was silica sand.

The mold was filled via the risers, at low pressure. The whole of the mold was turned over after filling it and blocking off the feed channel, and then solidified by gravity, before the subsequent operations of extracting the block from the mold, cooling, decoring (elimination of the coring sand by vibration hammering), sawing of the risers and deburring, all of which operations are conventional in themselves.

The aluminum alloy used was an aluminum-based alloy with the following composition:

silicon: 7.5%, copper: 3.0%, magnesium: 0.3% (modified with strontium), aluminum: remainder.

The temperature of the cast metal was 710° C. and the imprint took 30 seconds to fill. The subsequent overturning took 5 seconds.

In the above operation, the cast iron liners were neither heated nor coated in accordance with the invention prior to casting. They had a machined external profile featuring a helicoidal groove with a circular section having a radius of approximately 1 mm, a width of approximately 1.85 mm and a depth of approximately 0.4 mm, with a helix pitch of approximately 3 mm. After cutting the block for analysis and direct observation of the liner-alloy interface in the area between the liners, significant misruns were observed, virtually systematically; in other words it was not possible to guarantee correct coating of the cast iron by the aluminum alloy.

EXAMPLE B (PRIOR ART)

The molding process was exactly the same as that described for example A except that when the liner support cores were made they were hollowed out by means of spindles and the liners were heated prior to casting by inductors inserted through these openings. It is typically necessary to heat the liners before introduction into the casting station to a temperature of the order of 500 to 550°

C. to obtain a liner temperature of the order of 400° C. during casting.

Good coating of the liners by the liquid alloy was obtained and, after solidification and examination of the block, it was apparent that the alloy was intimately applied to the surface of the liner, espousing all its exterior reliefs, including in the area between the liners that proved a problem in example A. The block was functionally satisfactory.

However, the above process is complex: apart from the investment and electrical power consumption costs inherent to induction heating, which in this case relies on magnetic coupling and is therefore of relatively low efficiency, this process requires boring of the sand to enable the inductors to reach the openings in the core in each liner, which causes difficult problems in guaranteeing a seal at the surfaces of contact between the sand and the set of cores in line with these passages. Also, any change in the throughput of the process affects the waiting time between heating the liners and casting, with the risk of causing scrap castings through excessive cooling of the liners which then, during casting, gives rise to the same problems as in example A.

EXAMPLE C (IN ACCORDANCE WITH THE INVENTION)

The molding process was exactly the same as that described for example A, except that the liners were coated with lampblack after firing the liner support cores; four sets each consisting of a liner support core PCH and two cast iron liners C were manipulated at a distance of approximately 40 to 60 mm above an oxyacetylene torch flame adjusted to produce lampblack so that the liners were totally coated with lampblack. Deposition took approximately 40 seconds per liner and the liners, which became slightly heated during this operation, were then cooled naturally to room temperature in still air. During deposition the cores were masked to prevent deposition of lampblack on the sand.

The cores were then assembled as in example A, after which the metal was cast under the same conditions. After the engine block solidified, the coating quality and the intimate contact between the aluminum alloy and the liner were at least as good as in example B, although the casting operation was greatly facilitated. This is because, in the process in accordance with the invention, no mechanical or thermal intervention on the liners was required prior to casting. In particular, avoiding the need to bore the sand eliminates all risk of aluminum alloy leaking out during casting between the green sand and the chemical cores, which were made in a cold box.

The process in accordance with the invention was also applied with success to the same engine block by spraying onto the liners a mixture of methanol and carbon black, the carbon black being maintained in suspension by an agitator at a concentration of lampblack of 9 wt %. A compressed air gun was used for this purpose, operating at a pressure of $2.10^5$ Pa, and with a distance between the gun and the liner of the order of 50 to 100 mm.

It was also verified that the process according to the invention could be used successfully to cast engine blocks by gravity in a metal mold by depositing lampblack onto the liners before assembly thereof into the metal mold in the casting position.

Of course, the present invention is in no way limited to the embodiments described, many variants and modifications of which will be evident to the skilled person.

What is claimed is:

1. A process of fabricating an aluminum-based alloy cast component, including at least one metal insert, which process comprises;

applying a coating of lampblack to a face of said insert intended to be in contact with an alloy of said component, placing said insert with said lampblack coating in a mold cavity, and casting said component with a molten alloy in the mold cavity in which said insert has been placed without previously removing any substantial part of said lampblack coating and without previously applying any substantial heat to said insert.

2. The process claimed in claim 1, wherein said applying a coating of lampblack is carried out before introducing said insert into a mold cavity.

3. The process claimed in claim 1 which further includes fixing said insert to a sand core and placing said core in said mold cavity.

4. The process claimed in claim 3, wherein said fixing said insert to a core includes positioning said insert in a core box and then firing said core.

5. The process claimed in claim 3, wherein said applying a coating of lampblack to said insert is carried out before fixing said insert to said core.

6. The process claimed in claim 1, wherein said applying a coating of lampblack is carried out by exposing said face of said insert to a flame.

7. The process claimed in claim 6, including relative movement between the insert and the flame during said exposure of the insert to the flame.

8. The process claimed in claim 1, wherein said applying a coating of lampblack is carried out by spraying onto said face of said insert a solution containing lampblack in suspension.

9. The process claimed in claim 8, wherein said solution is based on an alcohol such as methanol.

10. The process claimed in claim 9, wherein said solution contains a dispersive agent such as gum arabic.

11. The process claimed in claim 1, wherein said component is an internal combustion engine block and said insert is a cylinder liner for said engine block.

12. The process claimed in claim 11, wherein said liner is made of cast iron.

13. The process claimed in claim 11, wherein said outside face of said liner has a surface with hollows and reliefs.

14. The process claimed in claim 11, wherein said applying a coating of lampblack to said liner applies said coating to the whole of the outside face of said liner.

15. The process claimed in claim 11, wherein said engine block has a plurality of inserts each constituting a cylinder liner.

16. A process of fabricating an aluminum-based alloy cast component, including at least one metal insert, the process comprising:

applying a coating of lampblack to a face of said insert intended to be in contact with an alloy of said component, placing said insert with said lampblack coating in a mold cavity without brushing off the applied lampblack and without heating the insert after applying the lampblack coating and before placing the insert in the mold cavity, and casting said component with a molten alloy in the mold cavity in which said insert with said lampblack coating is positioned without removing any substantial part of said lampblack coating and without previously applying any substantial heat to said insert, wherein substantially all the applied lampblack remains on said face of said insert.

* * * * *